US007801469B2

(12) United States Patent
Uezono

(10) Patent No.: US 7,801,469 B2
(45) Date of Patent: Sep. 21, 2010

(54) TONER CARTRIDGE

(75) Inventor: Tsutomu Uezono, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 378 days.

(21) Appl. No.: 11/937,635

(22) Filed: Nov. 9, 2007

(65) Prior Publication Data

US 2008/0279595 A1 Nov. 13, 2008

(30) Foreign Application Priority Data

May 11, 2007 (JP) ..... 2007-126325

(51) Int. Cl.
*G03G 15/08* (2006.01)

(52) U.S. Cl. ..... 399/263; 399/119

(58) Field of Classification Search ..... 399/119, 399/120, 252, 254, 256, 258, 260, 262, 263
See application file for complete search history.

(56) References Cited

U.S. PATENT DOCUMENTS

| | | | | |
|---|---|---|---|---|
| 4,973,541 | A | 11/1990 | Kohri et al. | |
| 5,491,537 | A * | 2/1996 | Suzuki et al. | 399/262 |
| 5,701,568 | A * | 12/1997 | Hiroshima et al. | 399/302 |
| 6,733,945 | B2 | 5/2004 | Hirota et al. | |
| 2004/0191666 | A1 * | 9/2004 | Kamada et al. | 430/125 |
| 2004/0259016 | A1 | 12/2004 | Oya et al. | |

FOREIGN PATENT DOCUMENTS

| | | | |
|---|---|---|---|
| JP | 03-289687 | A | 12/1991 |
| JP | 2002-006610 | A | 1/2002 |
| JP | 2002-236410 | A | 8/2002 |
| JP | 2002-296884 | A | 10/2002 |
| JP | 2003-043795 | A | 2/2003 |
| JP | 2003-156927 | A | 5/2003 |
| JP | 2005-134725 | A | 5/2005 |
| JP | 2006-098491 | A | 4/2006 |

* cited by examiner

*Primary Examiner*—David P Porta
*Assistant Examiner*—Benjamin Schmitt
(74) *Attorney, Agent, or Firm*—Sughrue Mion, PLLC

(57) ABSTRACT

The toner cartridge is provided with: a toner storing container of a rectangular shape having a toner feeding opening in an angular portion thereof; and a stirring conveying member that is rotatably disposed inside the toner storing container in a predetermined rotation direction and that stirs and conveys toner toward the toner feeding opening in the toner storing container. Compression ratio defined by the following equation (1) of the toner stored in the toner storing container is 0.25 to 0.38.

$$\text{Compression ratio}=(P-A)/P \quad (1)$$

(Provided that in the equation (1), P represents a packed bulk density of toner and A represents an aerated bulk density of toner.)

8 Claims, 10 Drawing Sheets

TONER CARTRIDGE

CROSS REFERENCE TO RELATED APPLICATIONS

This application is based on and claims priority under 35 USC §119 from Japanese patent application No. 2007-126325 filed May 11, 2007.

BACKGROUND

1. Technical Field

The present invention relates to a toner cartridge storing toner.

2. Related Art

As a toner cartridge used in an image forming apparatus such as a copying machine, a printer and the like adopting an electrophotographic system, there has been used a toner cartridge configured so that a feeding developer in a container is supplied to a developing device at a predetermined timing and simultaneously a waste developer including a carrier and the like which are used and deteriorated in the developing process is recovered.

SUMMARY

According to an aspect of the invention, there is provided a toner cartridge including: a toner storing container of a rectangular shape having a toner feeding opening in an angular portion thereof; and a stirring conveying member that is rotatably disposed inside the toner storing container and in a predetermined rotation direction and that stirs and conveys toner toward the toner feeding opening in the toner storing container. Compression ratio defined by the following equation (1) of the toner stored in the toner storing container is 0.25 to 0.38.

$$\text{Compression ratio}=(P-A)/P \quad (1)$$

(Provided that in the equation (1), P represents a packed bulk density of toner and A represents an aerated bulk density of toner.)

BRIEF DESCRIPTION OF THE DRAWINGS

Exemplary embodiment(s) of the present invention will be described in detail based on the following figures, wherein.

DETAILED DESCRIPTION

Hereinafter, the present invention will be explained with reference to the preferred embodiment (the present exemplary embodiment) for carrying out the present invention. Further, the present invention is not limited to the present exemplary embodiments described below but may be carried out in various modified modes within the gist of the invention. Furthermore, the drawings used here may not represent the real size but are used to explain the present exemplary embodiments.

(Image Forming Apparatus)

Figure 1:
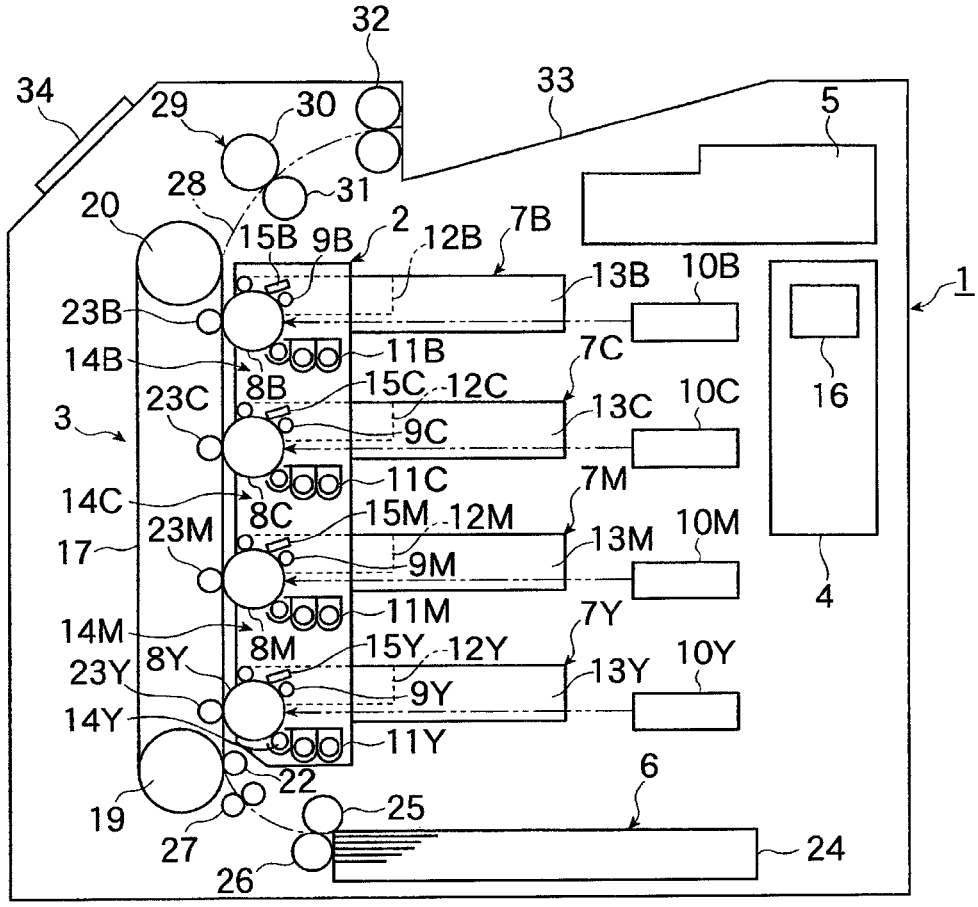
FIG. 1 is a configuration diagram showing the whole configuration of the image forming apparatus according to the present exemplary embodiment.
Figure 2:
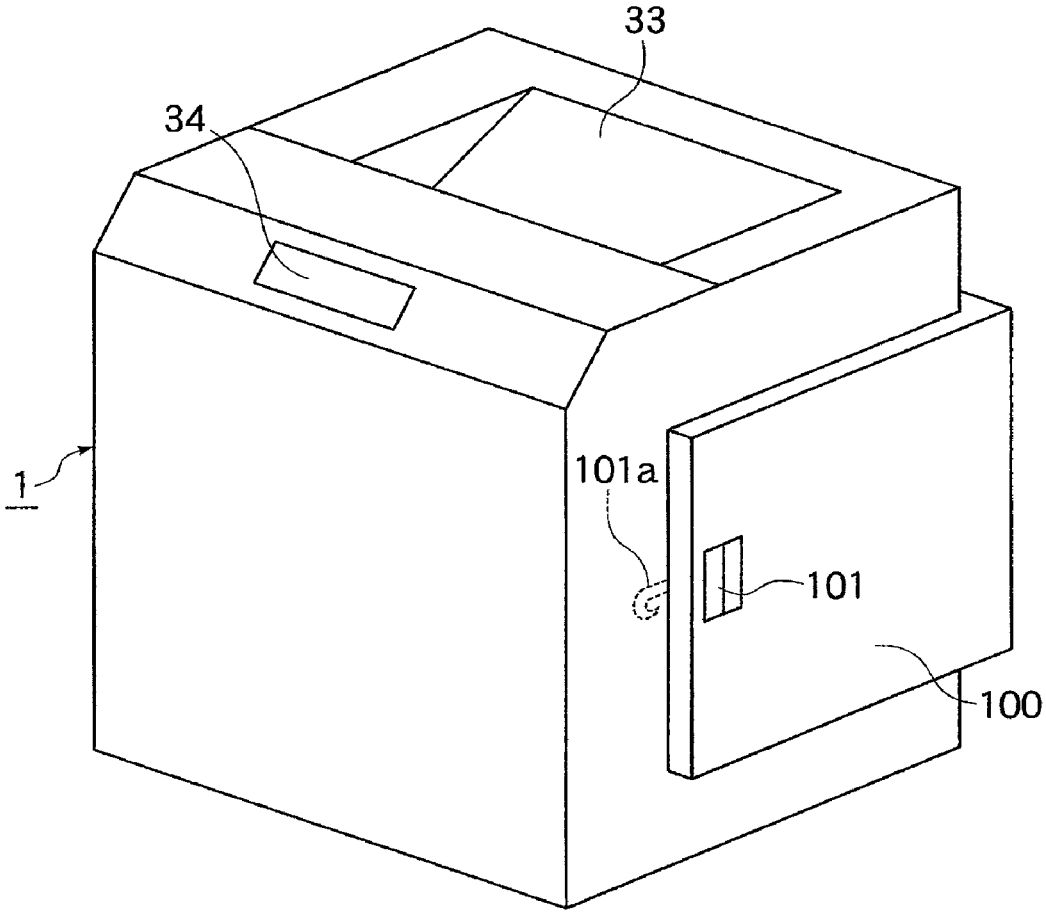
FIG. 2 is a perspective view showing an appearance of the image forming apparatus.
Figure 3:
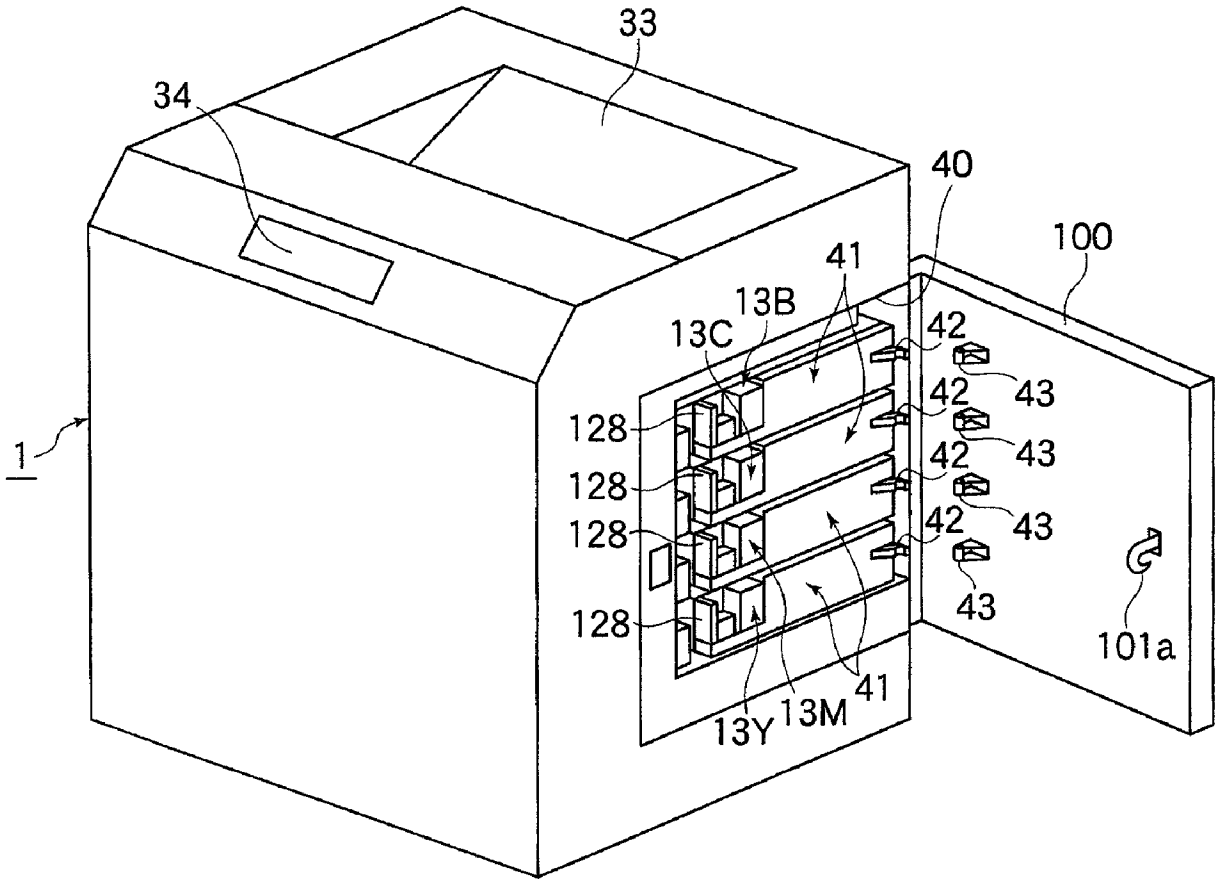
FIG. 3 is a perspective view showing the state where the cover of the image forming apparatus is opened.

By using FIGS. 1 to 3, the whole configuration of an image forming apparatus relating to the present exemplary embodiment will be explained. FIG. 1 is a configuration diagram showing the whole configuration of the image forming apparatus according to the present exemplary embodiment. FIG. 2 is a perspective view showing an appearance of the image forming apparatus. FIG. 3 is a perspective view showing the state where the cover of the image forming apparatus is opened.

The image forming apparatus shown in FIGS. 1 to 3 has a body 1, and the inside of the body 1 of the image forming apparatus has an image forming unit 2 and a paper conveying belt unit 3 which transfers toner images in plural colors formed by the image forming unit 2 along the up-and-down direction. In addition, the image forming apparatus has a control unit 4 equipped with a control circuit and the like, a power supply circuit unit 5 equipped with a high-voltage power supply circuit and a paper feeding device 6 which feeds a sheet of transfer paper as a transferring agent.

The image forming unit 2 has four image forming portions 7Y, 7M, 7C and 7B which form toner images of each color of yellow (Y), magenta (M), cyan (C) and black (B). The four image forming portions 7Y, 7M, 7C and 7B are disposed in series at given intervals along the up-and-down direction of the image forming apparatus.

The four image forming portions 7Y, 7M, 7C and 7B have a similar configuration. In other words, the image forming portions 7Y, 7M, 7C and 7B have a photoreceptor drum 8 (8Y, 8M, 8C and 8B) which holds a toner image, a charging roll 9 (9Y, 9M, 9C and 9B) which charges the surface of the photoreceptor drum 8 uniformly, an optical writing device 10 (10Y, 10M, 10C and 10B) which forms an electrostatic latent image by exposing an image corresponding to each color onto the surface of the photoreceptor drum 8, a developing device 11 (11Y, 11M, 11C and 11B) which develops the electrostatic latent image formed on the photoreceptor drum 8 with toner of the corresponding color, a cleaning device 12 (12Y, 12M, 12C and 12B) which cleans the transfer remaining toner remaining on the photoreceptor drum 8 and a toner cartridge 13 (13Y, 13M, 13C and 13B) which feeds toner to the developing device 11.

The developing device 11 feeds a two-component or one-component developer stored inside thereof to a developing roll 14 (14Y, 14M, 14C and 14B) while stirring the developer, and develops the electrostatic latent image formed on the photoreceptor drum 8 with toner of a predetermined color.

The cleaning device 12 removes the transfer remaining toner remaining on the surface of the photoreceptor drum 8 with a cleaning blade 15 (15Y, 15M, 15C and 15B). The transfer remaining toner removed is conveyed and stored inside of the cleaning device 12.

The control unit 4 is provided with, for example, an image processing system (IPS) 16 which performs predetermined image processing on image data. The image processing system 16 sequentially outputs image data of each color of yellow (Y), magenta (M), cyan (C) and black (B) into the optical writing device 10. The optical writing device 10 irradiates four laser beams LB onto each of the photoreceptor drums 8Y, 8M, 8C and 8B depending on image data to form an electrostatic latent image by scan exposure.

The paper conveying belt unit 3 is equipped with a paper conveying belt 17 which circulates and moves. The paper conveying belt 17 conveys a sheet of transfer paper supplied by the paper feeding device 6 in a state of electrostatic absorption. The toner image of each color formed in each of the image forming portions 7Y, 7M, 7C and 7B is transferred onto the sheet of transfer paper. The paper conveying belt 17 is stretched with a predetermined tension force between a driving roll 19 (a tension roll) and a driven roll 20 which are disposed along the vertical direction. Further, the paper conveying belt 17 is rotated and moved at a given velocity in the counterclockwise direction by the driving roll 19 which is rotationally driven by a driving motor (not shown in the figure).

In addition, an adsorbing roll 22 is contacted with the surface of the driving roll 19 through the paper conveying belt 17, thus allowing the sheet of transfer paper to be adsorbed electrostatically to the surface of the paper conveying belt 17.

Transfer rolls 23Y, 23M, 23C and 23B superimposedly transfer the toner images of each color formed on the photoreceptor drums 8Y, 8M, 8C and 8B by overlapping them each other onto a sheet of transfer paper which is adsorbed to the surface of the paper conveying belt 17 and is conveyed.

The paper feeding device 6 is disposed at the bottom of the body 1 to feed a sheet of transfer paper. The paper feeding device 6 is equipped with a paper tray 24 for housing sheets of transfer paper with the desired size and quality. A feeding roll 25 feeds a sheet of transfer paper from the paper tray 24. A separating roll 26 separates sheets of transfer paper one by one. A resist roll 27 conveys a sheet of transfer paper to the adsorption position on the paper conveying belt 17 at a predetermined timing.

The sheet of transfer paper on which toner images of each color are superimposedly transferred is separated from the paper conveying belt 17 by the rigidity (so-called, stiffness) which the sheet of transfer paper by itself has and then is conveyed to a fixing device 29 along a conveying route 28. Then, the fixing device 29 fixes the toner images of each color on the sheet of transfer paper. The fixing device 29 is rotationally driven in a state where a heating roll 30 and a pressure belt 31 are brought into contact with each other with pressure, and the sheet of transfer paper is passed through a nip portion formed between the heating roll 30 and the pressure belt 31 and then is subjected to a fixing treatment with pressure and heat. Thereafter, the sheet of transfer paper on which toner images of each color are fixed is fed out on an exit tray 33 disposed on the upper side of the body 1 by an exit roll 32, and then, the printing operation is completed. Further, the body 1 is equipped with an operation panel 34 which displays a state of an image forming apparatus and performs a required operation and the like.

Each image forming portion 7Y, 7M, 7C or 7B is provided with each toner cartridge 13Y, 13M, 13C or 13B as a developer storing container which stores each toner fed into each developing device 11Y, 11M, 11C or 11B of each color.

As shown in FIG. 2, the toner cartridges 13Y, 13M, 13C and 13B of each color of yellow (Y), magenta (M), cyan (C) and black (B) may be replaced by opening an opening and closing cover 100 disposed on the side of the body 1. The opening and closing cover 100 is opened by releasing the locked state of a hook 101*a* by manually pulling a gripper 101.

As shown in FIG. 3, the toner cartridges 13Y, 13M, 13C and 13B are mounted on an opening portion 40 exposing to the side of the body 1 so as to be detachable in a state of being mounted on a cartridge holder 41. Each toner cartridge 13Y, 13M, 13C or 13B differs in color of toner stored but is basically equipped with a similar configuration.

As shown in FIG. 3, an arm 42 is turnably attached to the cartridge holder 41 in a state where the tip is protruded, and the tip engages with an engaged portion 43 disposed on the opening and closing cover 100. The cartridge holder 41 turns from the body 1 in conjunction with the opening operation of the opening and closing cover 100 and moves to the detaching position. The toner cartridges 13Y, 13M, 13C and 13B are fixed by operating a handle member 128 disposed on the toner cartridges 13Y, 13M, 13C and 13B in a state where they are mounted in the operating position in the opening portion 40 of the body 1.

(Toner Cartridge 13)

Next, the toner cartridge 13 (13Y, 13M, 13C and 13B) to which the present exemplary embodiment is applied will be described in detail.

Figure 4:
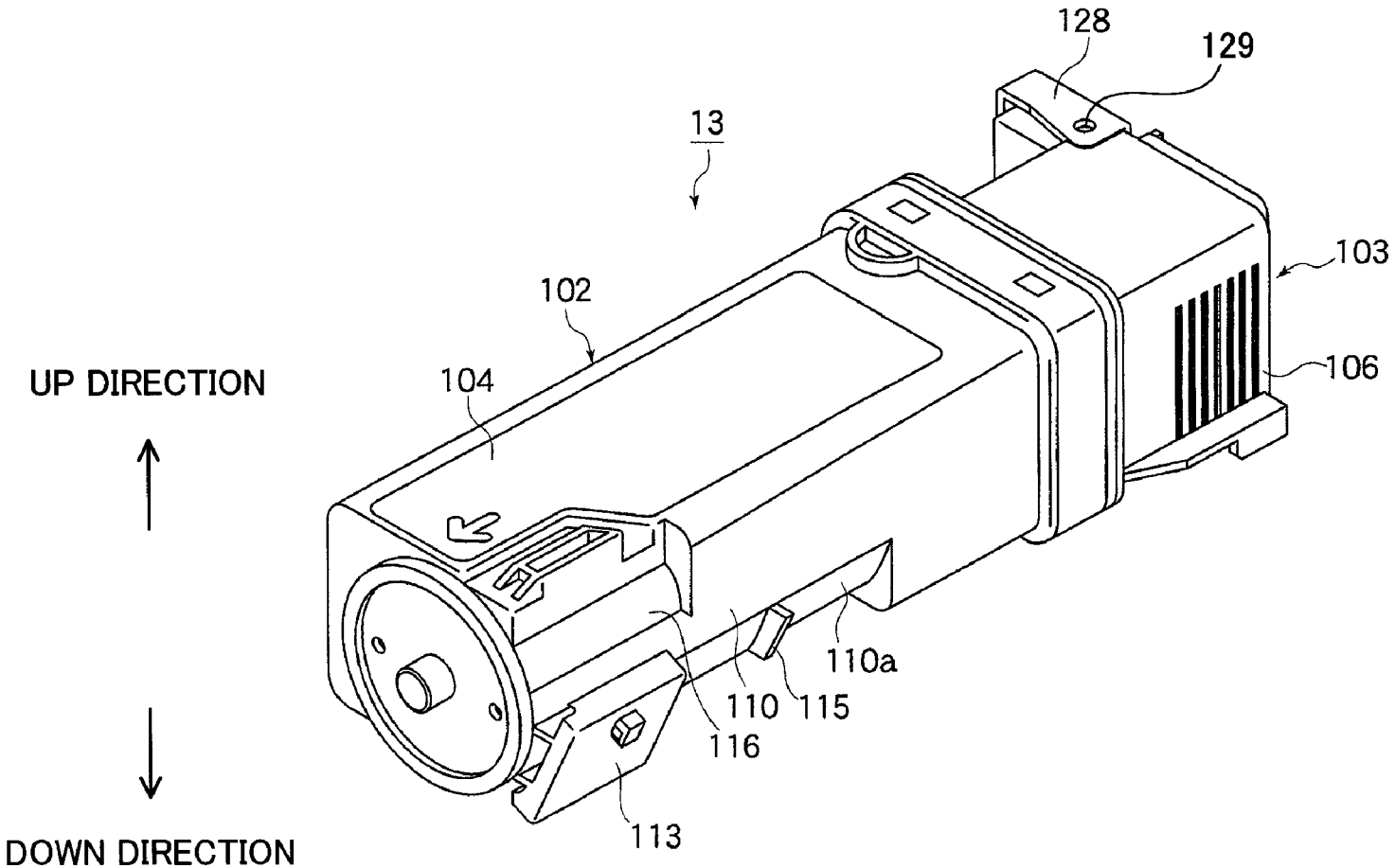
FIG. 4 is a perspective view showing an appearance of a toner cartridge according to the present exemplary embodiment.
Figure 5:
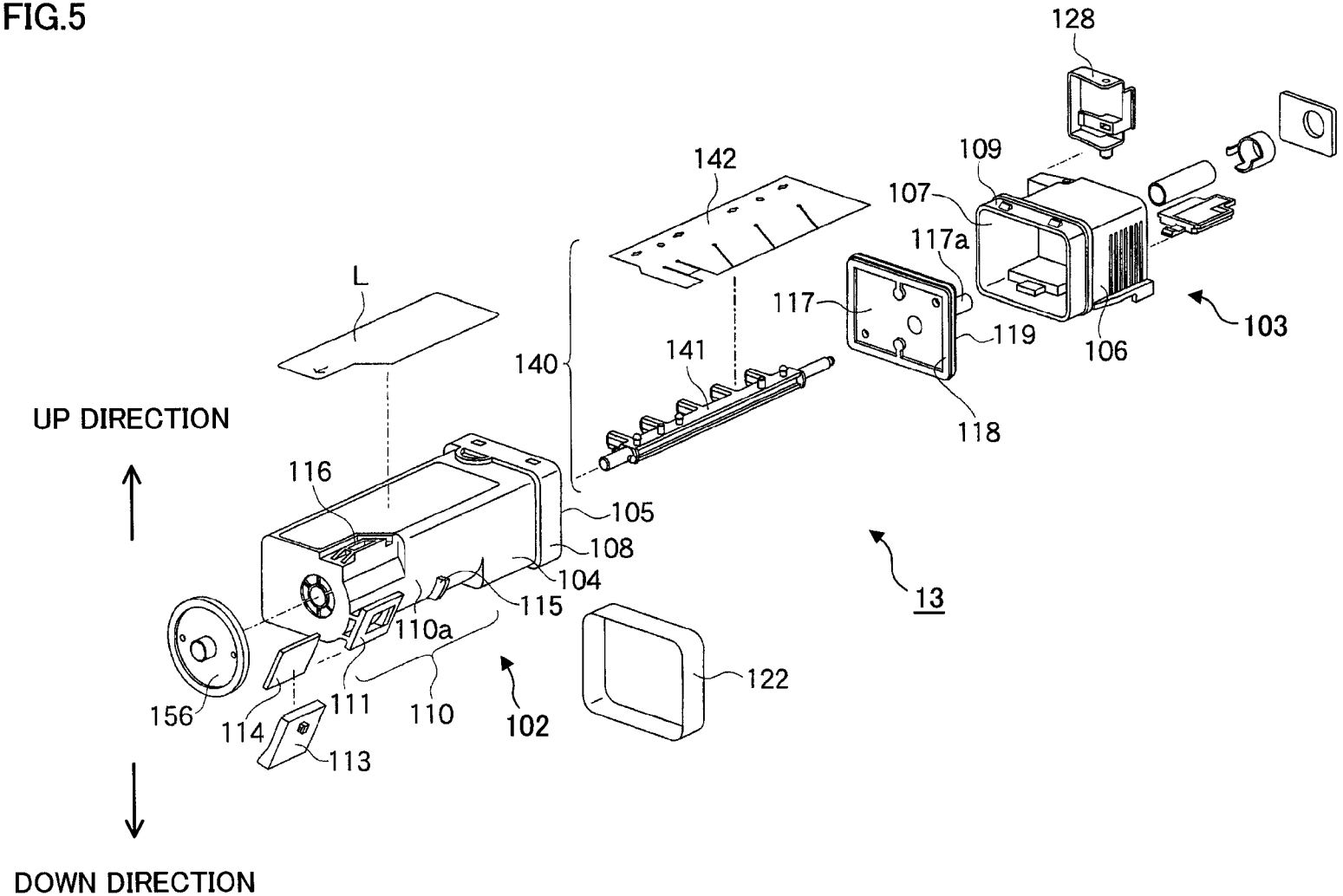
FIG. 5 is a configuration diagram showing a state where the toner cartridge is disassembled.

FIG. 4 is a perspective view showing an appearance of a toner cartridge 13 according to the present exemplary embodiment. Further, FIG. 5 is a configuration diagram showing a state where the toner cartridge 13 is disassembled.

As shown in FIG. 4, the toner cartridge 13 is configured as a box body of an elongated and rectangular-solid-like shape (a rectangular shape). The toner cartridge 13 has a feed toner storing portion 102 and a waste toner storing portion 103. The feed toner storing portion 102 stores a feed developer including new toner or a feed developer including new toner and a carrier. The waste toner storing portion 103 stores waste toner removed by the cleaning device 12, waste toner recovered from the developing device 11 or waste developer recovered from the developing device 11.

The feed toner storing portion 102 has a feed toner storing container 104 which is a rectangular container. The waste toner storing portion 103 is provided with a waste toner storing container 106 which is a rectangular container connected to a longitudinal end of the feed toner storing container 104. The feed toner storing portion 102 has a larger volume than the waste toner storing portion 103.

The feed toner storing container 104 is a box body of an elongated and a rectangular-solid-like shape having an opening portion 105 (refer to FIG. 5) in which the whole area is open on the side that faces the waste toner storing portion 103. In addition, the waste toner storing container 106 of the waste toner storing portion 103 is a box body of a cube-like shape having an opening portion 107 (refer to FIG. 5) in which the whole area is open on the side that faces the feed toner storing portion 102.

The feed toner storing container 104 and the waste toner storing container 106 may store a large amount of toner or waste toner in a limited attachment space by forming the cross section thereof to a rectangular shape, that is, a rectangular-solid-like shape or a cube-like shape, compared to the case of a cylindrical shape.

As shown in FIG. 5, the feed toner storing container 104 has a connection portion 108 at the end of the side where the opening portion 105 is located. The waste toner storing container 106 has a connection portion 109 fitting to the inner circumference of the connection portion 108 of the feed toner storing container 104 at the end of the side where an opening portion 107 is located.

The feed toner storing container 104 has a toner-feeding-side area 110 occupying the approximately two thirds portion of the side opposite to the opening portion 105 along the longitudinal direction. The toner-feeding-side area 110 has a side surface 110*a* formed in a circular arc shape.

The toner cartridge 13 has a driving portion 115 for moving the toner cartridge 13. In addition, a shutter 113 for opening and closing a toner feeding opening 111 is slidably attached to the toner feeding opening 111 along the horizontal direction. As shown in FIG. 5, a seal member 114 is adhered to the inside of the shutter 113.

Further, the feed toner storing container 104 and waste toner storing container 106 configuring the toner cartridge 13 are partitioned by a partition member 117 and seal members 118 and 119 as leak prevention members integrally disposed on the both sides, that is, the front side and the back side.

A cylindrical bearing portion 117*a* is integrally disposed to the partition member 117. The bearing portion 117*a* rotatably supports the rotational axis of an agitator shaft 141 of an agitator 140 as a stirring conveying member.

The cylindrical bearing portion 117*a* is formed so that the closed tip portion is extended to inside of the waste toner storing portion 103. Further, the tip portion is formed so that it is extended to the waste toner storing portion 103 more than the end of the connection portion 108 of the feed toner storing container 104.

Further, the bearing portion 117*a* of the partition member 117 also has a function as a gripper held by a robot hand of an automatic assembler when the toner cartridge 13 is assembled by mounting the partition member 117 to the inside of the connection portion 108 of the feed toner storing container 104 by the automatic assembler and the like.

In addition, a seal L on which various instructions and the like are printed is attached on the exterior top surface in the upward direction in a state similar to a state where the feed toner storing container 104 is attached to the body 1 of the image forming apparatus (an attachment state).

The outer circumference of the connection portions 108 and 109 are covered with a tape 122 in order to prevent the unexpected disengagement of the feed toner storing container 104 and the waste toner storing container 106. Further, the toner cartridge 13 may be easily disassembled and easily recycled by peeling off the tape 122.

On the waste toner storing container 106, the handle member 128 for attaching and fixing the toner cartridge 13 to a predetermined position is rotatably attached with a supporting point 129 (refer to FIG. 4) as the center.

As shown in FIG. 5, the agitator 140 is disposed inside of the feed toner storing portion 102 as a stirring conveying member which conveys a feed toner stored in the feed toner storing portion 102 while stirring the feed toner. The agitator 140 has the agitator shaft 141 as an axis portion rotatably supported and an agitator film 142 as a stirring conveying portion provided to the agitator shaft 141. Further, the rear end portion of the agitator shaft 141 is provided with a driving gear 156 for rotationally driving the agitator shaft 141.

Next, the structure of the feed toner storing container 104 of the toner cartridge 13 will be explained.

Figure 6A:
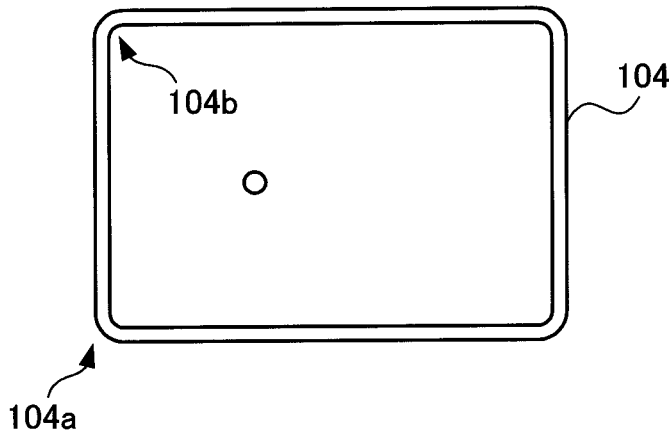
FIGS. 6A to 6C are sectional views of plural places in a direction perpendicular to the longitudinal direction of the feed toner storing container and show states where each cross-section is viewed from the side where the opening portion is located.
Figure 6B:
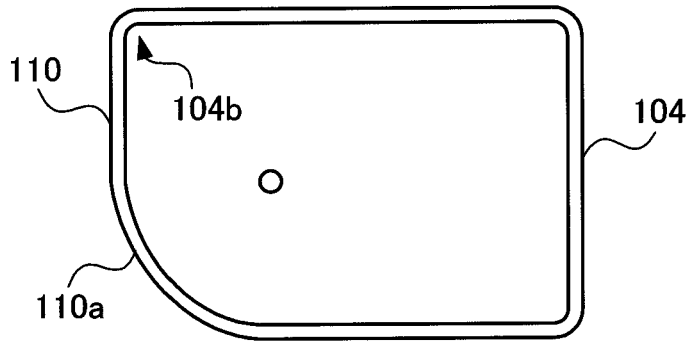
Figure 6C:
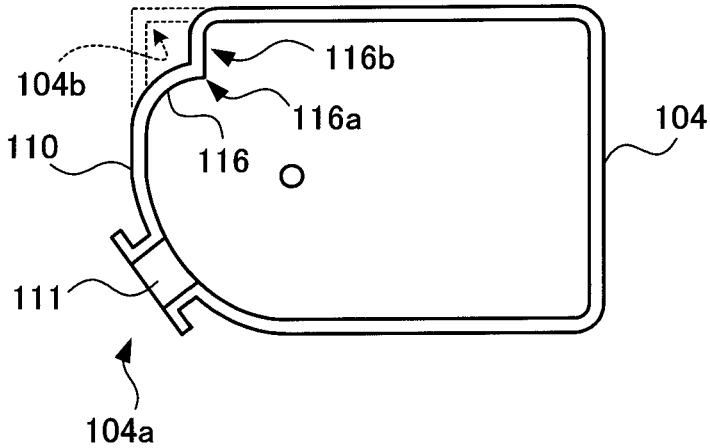

FIGS. 6A to 6C are sectional views of plural places in a direction perpendicular to the longitudinal direction of the feed toner storing container 104 and show states where each cross-section is viewed from the side where the opening portion 105 is located. The up-and-down directions in the states shown in FIGS. 6A to 6C correspond to the up-and-down directions in states similar to the attachment states of the toner cartridge 13 to the image forming apparatus.

FIG. 6A is a sectional view of the area occupying the approximately one-third from the side where the opening portion 105 is located in the longitudinal direction of the feed toner storing container 104. FIG. 6B is a sectional view of a portion relatively near to the side where the opening portion 105 is located within the toner-feeding-side area 110 occupying the approximately two-thirds portion from the side opposite to the opening portion 105 in the longitudinal direction of the feed toner storing container 104. FIG. 6C is a sectional view of the area including the toner feeding opening 111.

As shown in FIGS. 6A to 6C, the feed toner storing container 104 has an R shape of an angular portion (a corner portion) and the like, but forms a cross section of a rectangular shape (a rectangular-like shape) as a whole and has an angular portion 104*a* at the lower left in a state similar to the attachment state to the image forming apparatus (one side portion of the bottom of FIG. 6, on the side facing the body 1 of the image forming apparatus in the attachment state) and an corner portion 104*b* at the upper corner of the angular portion 104*a* inside of the feed toner storing container 104.

As shown in FIG. 6B, a portion corresponding to the angular portion 104*a* shown in FIG. 6A forms the side surface 110*a* of a circular arc shape in the toner-feeding-side area 110. Further, as shown in FIG. 6C, the toner feeding opening 111 which feeds a toner to the developing device 11 (refer to FIG. 1) in the end portion in a direction along the longitudinal direction of the side surface 110*a* formed in a circular arc shape is provided.

As shown in FIG. 6C, a curvature portion 116 is formed in the corner portion 104*b* located above the toner feeding opening 111. In addition, as shown in FIG. 6C, the curvature portion 116 has a bump 116*b* raised upward from a changing point 116*a*. The bump 116*b* expands the toner storing volume of the feed toner storing portion 102 and is configured so as to increase the toner storing capacity even in the case of a compact toner cartridge 13.

In general, around the corner (each corner portion) of the rectangular area, the so-called toner blocking in which the toner particles are agglomerated each other in a blocked state is likely to occur by the change of toner with time. For example, even if the toner cartridge 13 is stored upside down or sideways, the toner blocking directly above the toner feeding opening 111 may be prevented from occurring by replacing the corner portion 104*b* at the upper side of the toner feeding opening 111 with the curvature portion 116. Further, if the toner blocking occurs in the upper side of the toner feeding opening 111, the toner blocking may be easily transferred to a direction away from the side where the toner feeding opening 111 is located at the beginning of the rotation of the stirring conveying member (the agitator 140).

Figure 7:
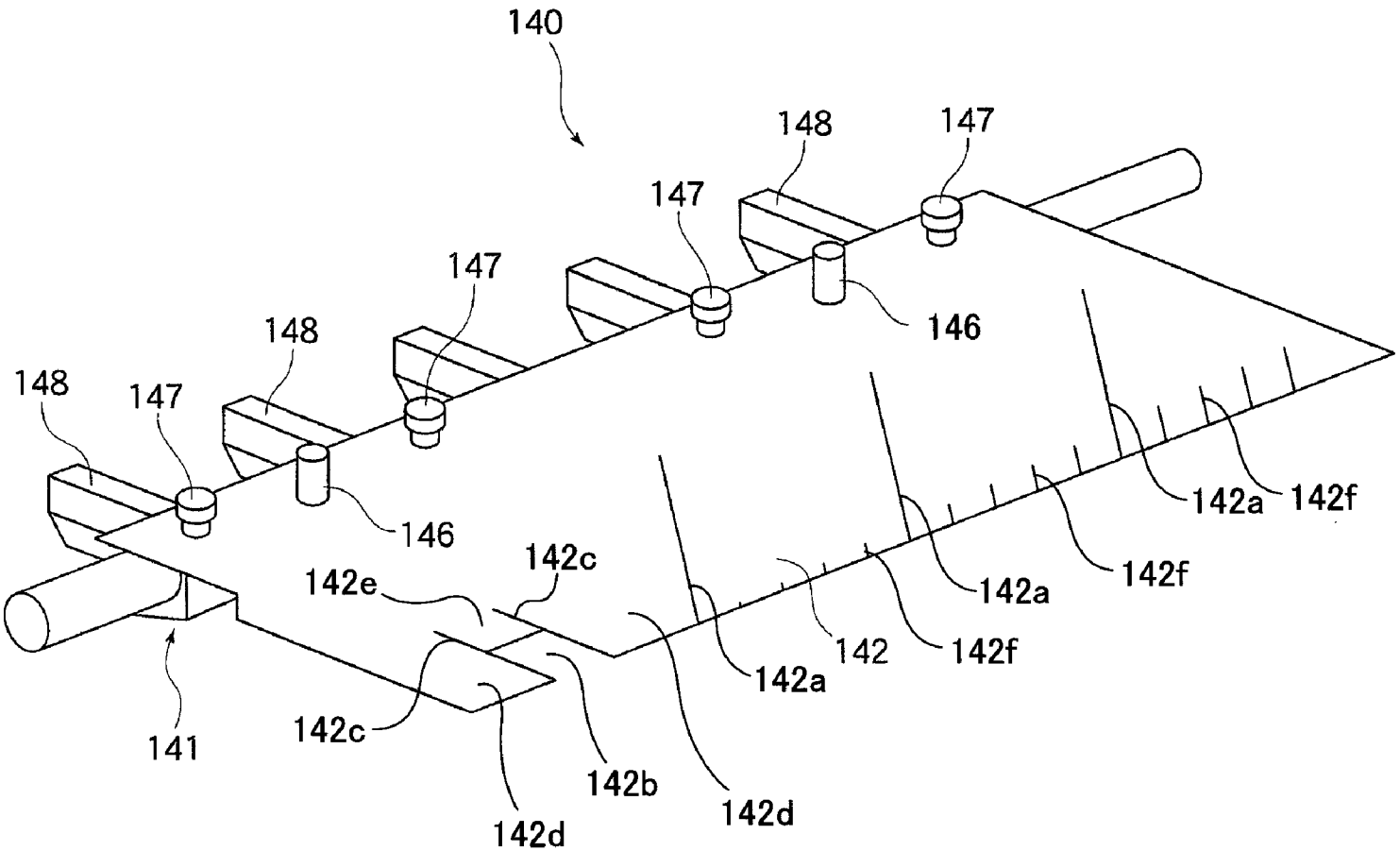
FIG. 7 is a perspective view showing the agitator as a stirring conveying member.

FIG. 7 is a perspective view showing the agitator 140 as a stirring conveying member. As mentioned above, the agitator 140 has the agitator shaft 141 as an axis portion that is a rotation center and the agitator film 142 as a stirring conveying portion. A concave portion 142*b* and cuts 142*c* are formed at the tip of the agitator film 142. In addition, more preferably, in order to adjust the conveying amount of toner and the like, the agitator film 142 has plural slits 142*a* having a predetermined slope angle, and has small slits 142*f* which have a cut amount smaller than the slit 142*a* at nearly the same slope angle as plural slits 142*a*.

A sliding portion 142*d* sliding the inner circumferential surface of the toner-feeding-side area 110 (refer to FIG. 6) is formed by one slit 142*a* and the cut 142*c* when the agitator film 142 is rotated. In addition, between the two cuts 142*c*, a cutout portion (an insertion portion) 142*e* which is inserted into the toner feeding opening 111 to facilitate the discharge of toner when the agitator film 142 is rotated is formed. In other words, the agitator 140 has the cutout portion 142*e* which may be inserted into the toner feeding opening 111 and the sliding portion 142*d* which is disposed adjacent to the both ends of the cutout portion 142*e* at the tip side of the agitator 140 (the tip side of the agitator film 142). The sliding portion 142*d* has a length from the rotation center longer than the cutout portion 142*e* and slides the inner wall of the feed toner storing container 104 of the side portion of the toner feeding opening 111.

The agitator film 142 of the agitator 140 is formed, for example, by a film sheet made of polyethylene terephthalate (PET) and has flexibility to a degree that it is distorted by the pressure applied by the toner stored in the feed toner storing container 104. Further, the tip side away from the agitator shaft 141 as the rotation center may slide the curvature portion 116 (refer to FIG. 6C) of the feed toner storing container 104.

In the present exemplary embodiment, since the fluidity of toner is favorably maintained by the use of the toner having a compression ratio of 0.25 to 0.38, the toner may be conveyed to the side where the toner feeding opening 111 is located even if the agitator 140 conveying the toner perpendicular to the direction of the rotation axis is used. Further, in addition to this, the deflection amount of the agitator film 142 on the both sides of the slit 142*a* may be significantly different by forming the slits 142*a*, and thereby it may be easier to convey the toner to the side of the toner feeding opening 111.

The width of the cutout portion (the insertion portion) 142*e* specified by the two cuts 142*c* is smaller than the width in the axis direction (the longitudinal direction of the feed toner storing container 104) of the toner feeding opening 111 of the feed toner storing container 104. Further, the size of the concave portion 142*b* is determined depending on the length of the cutout portion 142*e* formed. The shape of the cutout portion 142*e* is determined by the two cuts 142*c*, the length of the two cuts 142*c* and the size of the concave portion 142*b*. Furthermore, the shape of the cutout portion 142*e* is determined depending on the function of the cutout portion 142*e* which is inserted into the toner feeding opening 111 and tipped up. In addition, the dimension by which the toner is favorably discharged is selected by the cutout portion 142*e*. Further, the length of the cutout portion 142*e* is a length such that the tip side away from the agitator shaft 141 as the rotation center may slide the curvature portion 116 of the feed toner storing container 104.

The agitator film 142 having such a shape is attached to the agitator shaft 141 in a state where the agitater film 142 is inserted into protrusions 146 and 147. The agitator shaft 141 which is an axis portion has plural protrusions 148 protruding toward the outside from the rotation center in the longitudinal direction. Even if toner blocking occurs, the toner blocking may be relatively rapidly loosened by the plural protrusions 148. In addition, the toner blocking is loosened by using the conveying power of the agitator film 142 of the feed toner storing container 104.

FIGS. 8A to 8D are diagrams for explaining a rotation state of a stirring conveying member in the feed toner storing container 104. The agitator 140 which is a stirring conveying member rotates in the arrow direction of the figures taking a center axis 141*a* of the agitator shaft 141 as the rotation center. By this rotation, the blade portion (tip) of the agitator film 142 is brought into contact with the inner surface of the feed toner storing portion 102 (the feed toner storing container 104) to deflect. At this time, the agitator film 142 is rotatably driven in a state where it is spirally deformed because it has slits 142*a*. The agitator 140 stirs the feed toner stored in the feed toner storing portion 102 by the rotational driving, transfers the toner towards the toner feeding opening 111 disposed at the angular portion (the corner portion) in the one side of the feed toner storing portion 102 and gradually feeds the toner in the one side towards each of the developing devices 11Y, 11M, 11C and 11B from each of the toner cartridges 13Y, 13M, 13C and 13B.

Figure 8A:
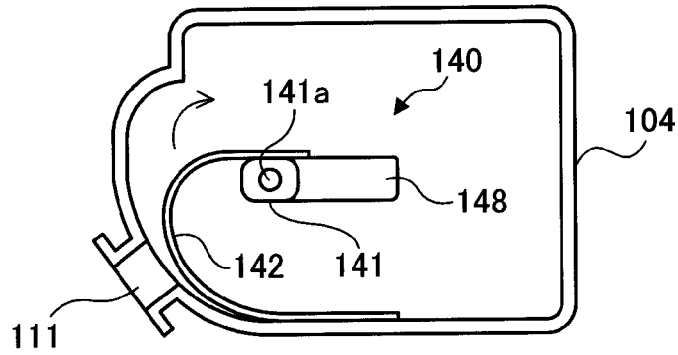
FIGS. 8A to 8D are diagrams for explaining a rotation state of a stirring conveying member in the feed toner storing container.
Figure 8B:
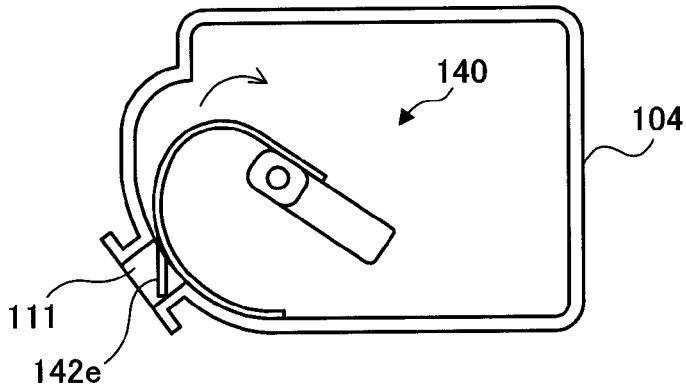

For example, when the state shown in FIG. 8A is transferred to the state shown in FIG. 8B, as shown in FIG. 8B, the cutout portion 142*e* of the agitator film 142 having a length shorter than the length of other blade portions is tipped up to the toner feeding opening 111. Thereby the toner conveyed in the feed toner storing container 104 may be suitably discharged from the toner feeding opening 111.

Figure 8C:
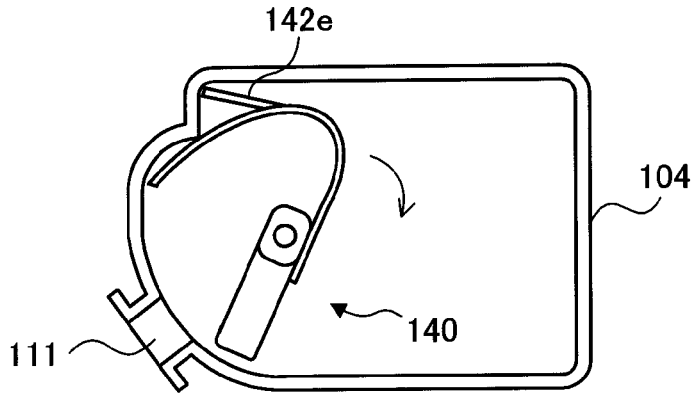

Further, when the state shown in FIG. 8B is transferred to the state shown in FIG. 8C, among the blade portions of the agitator film 142 which are contacting with the curvature portion 116, the cutout portion 142*e* having a short length is tipped up by the presence of the bump 116*b* at the changing point 116*a* (refer to FIG. 8C). The tipping up of the cutout portion 142*e* is effective for loosening the agglomerated toner (toner blocking).

Figure 8D:
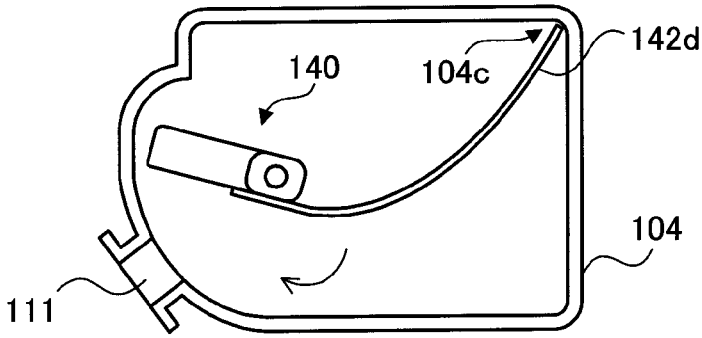

Furthermore, as shown in FIG. 7, the sliding portion 142*d* disposed adjacent to the cutout portion (the insertion portion) 142*e* at the blade portion of the agitator film 142 has a longer length from the rotation center than the cutout portion (the insertion portion) 142*e*. In addition, the sliding portion 142*d* slides the inner wall of the feed toner storing container 104 which is the most far away from the center axis 141*a*. For example, as shown in FIG. 8D, the tip of the sliding portion 142*d* may slide a corner portion 104*c* of the feed toner storing container 104.

Figure 9A:
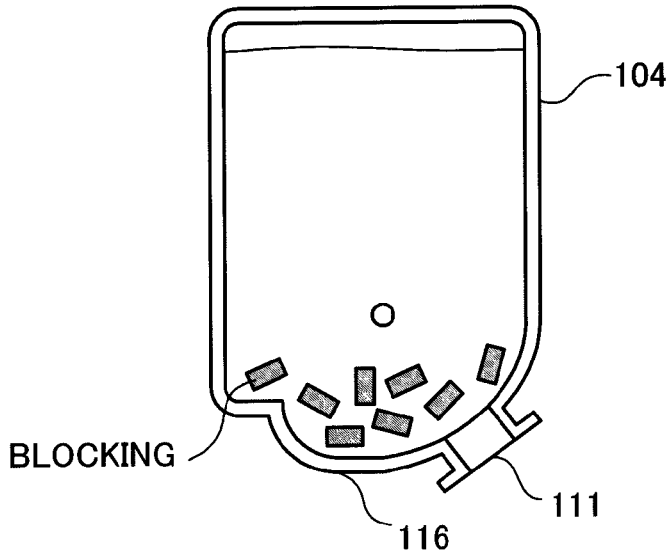
FIGS. 9A to 9C are diagrams for explaining supposed examples of the storage conditions of the toner cartridge and occurrence states of the toner blocking.
Figure 9B:
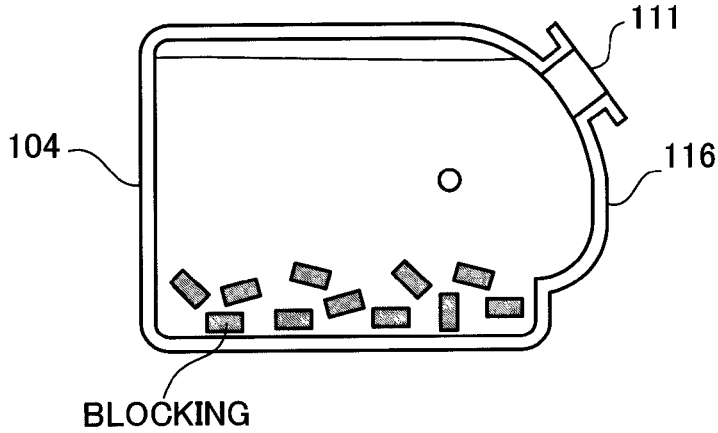
Figure 9C:
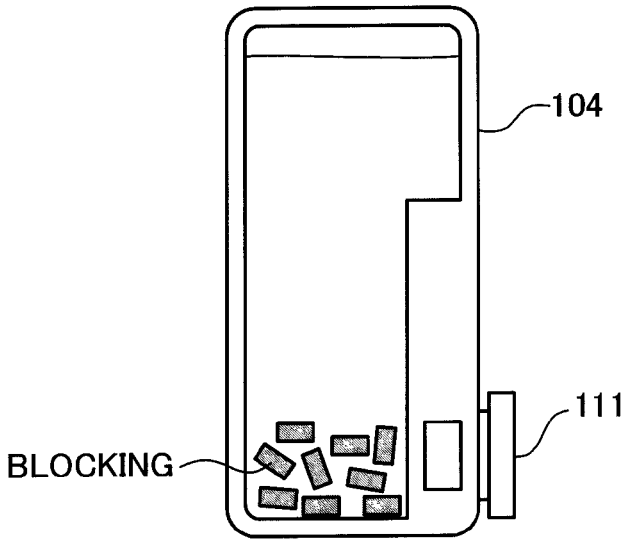

FIGS. 9A to 9C are diagrams for explaining supposed examples of the storage conditions of the toner cartridge 13 and occurrence states of the toner blocking. For example, FIG. 9A shows a state where the toner cartridge 13 is stored by the side having the curvature portion 116 of the feed toner storing container 104 down. In general, since the toner blocking is likely to occur at the bottom (lower side) of the loaded toner, and when the toner cartridge 13 is stored in a steady state for a long period of time, the toner is agglomerated, causing toner blocking. In the example of FIG. 9A, the toner blocking often occurs in the side having the curvature portion 116 of the toner cartridge 13.

FIG. 9B shows a storage condition in which the position where the toner cartridge 13 is attached to the image forming apparatus is turned upside down. The top side in the attachment position is also turned upside down and the toner blocking is likely to occur on the top side in the attachment position.

FIG. 9C shows a storage condition where the toner cartridge 13 is stored with the end of the feed toner storing container 104 in the longitudinal direction (in the toner feeding direction) down. In this case, the toner blocking is likely to occur at the end of the feed toner storing container 104 in the longitudinal direction.

If such toner blocking is directly transferred as it is through the toner feeding opening 111, toner clogging in the image forming apparatus and image quality deficiency are likely to occur. For such problems, problems are addressed if the toner blocking is loosened to transfer even when the toner blocking occurs. The effect of loosening the toner blocking is increased by flipping the tip of the cutout portion (the insertion portion) 142*e* of the agitator film 142 which rotates as shown in FIG. 8C at the bump 116*b* raising upward from the changing point 116*a* disposed in the curvature portion 116 as shown in FIG. 6C.

Next, the toner conveyance from the toner feeding opening 111 to the developing device 11 will be described. The toner feeding opening 111 of the toner cartridge 13 of each color and the developing device 11 are connected by a toner conveying pipe (not shown in the figure). The toner is conveyed to the developing device 11 by driving a conveying paddle (not shown in the figure) disposed in the toner feeding pipe at a constant speed. A motor (not shown in the figure) for driving the conveying paddle is turned on and off by the signal from the body 1 of the image forming apparatus to supply the toner when needed.

(Toner)

Next, toner used in the exemplary embodiment will be explained.

The toner used in the exemplary embodiment includes, at least, a binding resin, a coloring agent and wax and further includes other ingredients where necessary.

(Binding Resin)

The binding resin is not particularly limited if a conventionally known resin may be used and typically includes a homopolymer or copolymer of the following monomers. Such a monomer includes, for example, styrenes such as styrene and chlorostyrene; a monoolefin such as ethylene, propylene, butylene and isoprene; a vinyl ester such as vinyl acetate, vinyl propionate and vinyl benzoate; an α-methylene aliphatic monocarboxylic acid ester such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; a vinyl ether such as vinyl methyl ether, vinyl ethyl ether and vinyl butyl ether; and a vinyl ketone such as vinyl methyl ketone, vinyl hexyl ketone and vinyl isopropenyl ketone.

A representative binding resin includes, for example, polystyrene, styrene-alkyl acrylate copolymer, styrene-alkyl methacrylate copolymer, styrene-acrylonitrile copolymer, styrene-butadiene copolymer, styrene-maleic acid anhydride copolymer, polyethylene and polypropylene. Further, there may be mentioned polyester, polyurethane, epoxy resin, silicone resin, polyamide, modified rosin, paraffin and waxes. Among these, especially when a polyester resin is used as the binding resin, it may be effective for low-temperature fixability, offset and blocking properties.

Further, as the binding resin, especially preferable is a resin having a softening point of 90 to 150 degree C., a glass transition temperature of 55 to 75 degree C., having an acid value of 1 to 40 and having a hydroxyl value of 5 to 40.

These polyester resins are typically synthesized by the polycondensation of a polyol component and an acid component. The polyol component includes, for example, ethyleneglycol, propyleneglycol, 1,3-butanediol, 1,4-butanediole, 2,3-butanediol, diethyleneglycol, triethyleneglycol, 1,5-butanediole, 1,6-hexanediole, neopentylglycol, cyclohexanedimethanol, hydrogenated bisphenol A, bisphenol A-ethylene oxide adduct, bisphenol A-propylene oxide adduct and the like.

The acid component includes, for example, maleic acid, fumaric acid, phthalic acid, isophthalic acid, terephthalic acid, succinic acid, dodecenylsuccinic acid, trimellitic acid, pyromellitic acid, cyclohexane tricarboxylic acid, 1,5-cyclohexanedicarboxylic acid, 2,5,7-naphthalene tricarboxylic acid, 1,2,4-naphthalene tricarboxylic acid, 1,2,5-hexane tricarboxylic acid and 1,3-dicarboxyl-2-methylenecarboxypropane tetramethylene carboxylic acid, and anhydrides thereof.

(Coloring Agent)

As the representative coloring agent, there may be exemplified, for example, carbon black, nigrosine, aniline blue, carcoil blue, chrome yellow, ultramarine blue, Du Pont oil red, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment yellow 12, C.I. pigment yellow 17, C.I. pigment yellow 180, C.I. pigment blue 15:1, C.I. pigment blue 15:3 and the like.

In addition, there may be also used a flushing treatment product or high concentration pigment pellets. The flushing treatment product is obtained by kneading an aqueous paste of a pigment and an binding resin at a temperature of not less than the softening point of the binding resin under a normal pressure and followed by subjecting to flushing treatment. High concentration pigment pellets are prepared by heating and fusing the dried pigment of the same coloring agent and an binding resin while applying a high shearing force and followed, for example, by mixing by using a thermal type twin roll or triple roll, or the like. The latter is preferable from the standpoint of the dispersion of coloring agent.

The coloring agent content is typically 0.5 to 15 parts by weight and preferably 1 to 10 parts by weight based on 100 parts by weight of the binding resin. If the coloring agent content is excessively small, the tinting strength tends to be decreased. If the coloring agent content is excessively large, the transparency tends to be reduced.

The toner used in the present exemplary embodiment may be formed as a magnetic one-component developer by using a magnetic powder in part or whole of the coloring agent. As the magnetic powder dispersed in the binding resin, there is no particular limitation and the magnetic powder includes well-known powerly magnetic materials. For example, a magnetic material includes a metal such as iron, cobalt and nickel and an alloy thereof; a metal oxide such as $Fe_3O_4$, $\gamma$-$Fe_2O_3$ and cobalt-added iron oxide; various ferrites such as Mn—Zn ferrite and Ni—Zn ferrite; magnetite, hematite and the like. In addition, there may be mentioned magnetic powders obtained by treating the surfaces of these magnetic powders with a surface treatment agent such as a silane coupling agent and a titanate coupling agent or polymer coated magnetic powders.

The blending ratio of the magnetic powder is typically 30 to 70% by weight and preferably 35 to 65% by weight relative to the toner particles. If the blending ratio of magnetic powder is excessively small, the binding force of toner by magnet in the toner carrier is weakened, thereby tending to cause toner scattering and fogging. If the blending ratio of magnetic powder is excessively large, the image concentration tends to be reduced.

The magnetic powders having an average particle diameter of 0.05 to 0.35 μm are typically preferable from the viewpoint of the dispersibility to the binding resin.

(Wax)

The wax includes, for example, paraffin wax and a derivative thereof, montan wax and a derivative thereof, microcrystalline wax and a derivative thereof, Fischer-Tropsch wax and a derivative thereof, polyolefin wax and a derivative thereof and the like. Here, the derivative includes an oxide, and polymer or a graft modified product with a vinyl monomer. In addition, an alcohol, an aliphatic acid, vegetable wax, animal wax, mineral wax, ester wax, an acid amide and the like may be also available.

The additive amount of the wax to toner is typically 1 to 10% by weight and preferably 3 to 8% by weight. If the additive amount of the wax is excessively small, sufficient fixing latitude (the temperature range of the fixing roll for fixing toner without offset of toner) is unlikely to be obtained. If the additive amount of the wax is excessively large, the amount of the free wax released from toner is increased, the powder fluidity of toner is deteriorated, and the free wax attaches to the surface of a photoreceptor forming an electrostatic latent image, and thereby an electrostatic latent image is unlikely to be formed accurately.

Further, the endothermic peak of the wax measured by a differential scanning calorimeter (DSC) is typically a temperature of 50 to 120 degree C., preferably of 60 to 115 degree C. and more preferably of 70 to 110 degree C.

(Other Components)

The toner used in the present exemplary embodiment includes other ingredients, as needed. The other components include, for example, a charge controlling agent for controlling the electrostatic charge of toner as an internal additive, a wax dispersing auxiliary agent and the like. Further, in order to improve the long-term storage stability, the fluidity, the developing property and the transferring property of toner, an inorganic powder and a resin powder may be added solely or in combination to the surface of toner.

The inorganic powder includes, for example, carbon black, silica, alumina, titania, zinc oxide, a metatitanic acid compound and the like. The inorganic powders may be used alone or in combination with two or more kinds. The total additive amount of the inorganic powders is typically 1 to 6% by weight and preferably 2.5 to 5% by weight relative to the toner particles.

The resin powder includes, for example, spherical particles such as polymethylmethacrylate (PMMA) resin, polyamide resin, melamine resin, benzoguanamine resin and fluorocarbon resin; and amorphous powders such as vinylidene chloride and fatty acid metal salt. The additive amount of the resin powder is typically 0.1 to 4% by weight and preferably 0.5 to 3% by weight relative to the toner particles. Each of the powders added to the surface may be subjected to a desired surface treatment.

The toner used in the present exemplary embodiment has a volume average particle diameter of typically approximately not more than 30 μm, preferably 3 to 20 μm and more preferably 5 to 9 μm.

The molecular weight of the toner used in the present exemplary embodiment has a number average molecular weight measured by gel permeation chromatography of typically 2,500 to 5,500, preferably 3,000 to 5,000 and more preferably 3,500 to 4,500. In addition, the toner has a weight average molecular weight of typically 13,000 to 25,000, preferably 15,000 to 23,000 and more preferably 16,000 to 20,000.

If the molecular weight of toner is excessively low, the mechanical strength of toner itself is reduced and the toner is pulverized when the toner is stirred in the course of the development, thereby tending to cause toner fogging. In addition, the fixed image intensity decreases and thus there is a tendency that the peeling off of toner may easily occur when the image is folded. In addition, the offset of toner tends to occur when fixing the toner. If the molecular weight of toner is excessively high, the gloss property decreases after the toner is fixed. Further, for example, the color saturation of a transparent image for an OHP (overhead projector) tends to decrease.

The toner used in the present exemplary embodiment may be used in either a one-component developing system or a two-component developing system. Among them, the toner is preferably used in a two-component developing system combined with a resin-coated carrier. When the toner is used in the two-component developing system, the resin-coated carrier is used as a carrier, and thereby it may improve the charge rising caused by the reduction of the toner particle diameter, the deterioration of the charge distribution, and the background staining or the density nonuniformity caused by the decrease of the charge amount.

The carrier is not particularly limited as long as the carrier is the conventionally known carrier. There may be used, for example, an iron powder-based carrier, a ferrite-based carrier, a surface-coated ferrite-based carrier or the like. The particle diameter of the carrier is typically 20 to 100 μm and preferably 25 to 60 μm.

(Compression Ratio of Toner)

The toner used in the present exemplary embodiment has a compression ratio defined by the following equation (1) in the range of 0.25 to 0.38.

$$\text{Compression ratio}=(P-A)/P \quad (1)$$

In the equation (1), P is a packed bulk density of toner. A is an aerated bulk density of toner.

Since the compression ratio defined by the equation (1) of toner used in the present exemplary embodiment is in the range of 0.25 to 0.38, the fluidity of toner in the feed toner storing container 104 of the toner cartridge 13 is suitably maintained. For this reason, the toner flows in a rotation axis direction on the surface of the agitator film 142 which is a rotating stirring conveying portion and the toner may not be accumulated or deposited in the angular portion 104*a* which is located at the bottom of the feed toner storing container 104 and the like.

In addition, the toner flow is promoted in a direction perpendicular to the rotation direction of the agitator 140 as a stirring conveying member. For this reason, the toner flow to the toner feeding opening 111 disposed at the end portion of the feed toner storing container 104 is sufficiently performed, thereby reducing the residual toner amount in the feed toner storing container 104.

If the compression ratio of toner is excessively small, the fluidity of toner is increased and the amount of flow from the toner feeding opening 111 of the feed toner storing container 104 tends to increase. For this reason, the seal structure for preventing the toner from leakage becomes complex, thereby tending to cause an obstacle for the miniaturization of the toner cartridge 13. In addition, when the toner is filled in the toner cartridge 13, it becomes difficult to fill a large amount of toner in a short period of time. Further, the amount of the toner fed out at the early stage becomes excessive, tending to make it difficult to maintain a fixed feed amount.

In addition, if the compression ratio of toner is excessively large, the fluidity of toner is decreased, tending to increase the toner amount remained in the feed toner storing container 104.

A method for adjusting the compression ratio of the toner used in the present exemplary embodiment in the range of 0.25 to 0.38 includes, for example, the following method, depending on the toner particle diameter and the amount of a release agent and the like. In other words, the toner has an average particle diameter of 5 to 9 μm and the ratio of particles having a particle diameter of not more than 4 μm is approximately 5 to 35%, and further approximately 60 to 180% of the surface area of the toner is coated with an inorganic metal oxide having a particle diameter of not more than 0.02 μm as an external additive relative to the surface area of toner. By doing this, the compression ratio of toner may be adjusted in the range of 0.25 to 0.38. Further, in general, as the particle diameter of toner becomes larger, as the ratio of the particles of not more than 4 μm is decreased, and as the amount of the release agent and the amount of the external additive are increased, the compression ratio of toner tends to decrease. For this reason, the compression ratio of toner is required to be adjusted in each case.

In the toner used in the present exemplary embodiment, various inorganic fine particles are added and blended for the purpose of improving durability of toner and powder fluidity and the like. As the inorganic fine particles added, there may be used, for example, a metal oxide such as silica, aluminum oxide, titanium oxide, barium titanate, magnesium titanate, calcium titanate, strontium titanate, zinc oxide, silica sand, clay, mica, sand-lime, diatom earth, cerium chloride, colcothar, chromium oxide, cerium oxide, antimony trioxide, magnesium oxide, magnesium carbonate, zirconium oxide, silicon carbide, silicon nitride, calcium carbonate and barium sulfate; ceramic particles and the like. Among these, preferable are particles which mainly comprise silica fine particles, aluminum oxide and titanium oxide. These may be used alone or in combination, but especially the preferable is particle which mainly comprises silica.

Depending on the particle diameter of toner, the additive amount of these inorganic particles is in the range of 0.05 to 20% by mass, more preferably 0.1 to 15% by mass and further more preferably 0.5 to 10% by mass relative to the toner in the point that the compression ratio of toner may be obtained in the range of 0.25 to 0.38. If the additive amount of the inorganic fine particles is excessively small, there occurs such a problem that the inorganic fine particles are embedded on the surface of toner due to the impact caused by stirring the toner and the like and the addition effect of the inorganic fine particles is not likely to be obtained. If the additive amount of the inorganic fine particles is excessively large, the inorganic fine particles and the like released from the toner attach to the developing roll 14 and the like, thereby tending to make it difficult to control the triboelectric charging.

In addition, the inorganic fine particles may be subjected to the hydrophobic treatment in order to improve the durability and fluidity of the inorganic fine particles. The hydrophobic treatment may be performed by using a typical hydrophobic agent. As the specific example of the hydrophobic agent, there may be mentioned, for example, a coupling agent such as a silane-based coupling agent, a titanate-based coupling agent, an aluminate-based coupling agent and a zirconium-based coupling agent; a silicone oil and polymer coating treatment and the like. These hydrophobic agents may be used alone or in combination. Among these, a silane-based coupling agent and silicone oil may be preferably used.

As the silane-based coupling agent, there may be used any type of a chlorosilane, alkoxysilane, silazane, specific silylizing agent. The specific example includes, for example, methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, ethyltrimethoxysilane, propyltrimethoxysilane, phenyltrimethoxysilane, diphenyldimethoxysilane, tetraethoxysilane, methyltriethoxysilane, dimethyldiethoxysilane, ethyltriethoxysilane, propyltriethoxysilane, phenyltriethoxysilane, diphenyldiethoxysilane, butyltrimethoxysilane, butyltriethoxysilane, isobutyltrimethoxysilane, hexyltrimethoxysilane, octyltrimethoxysilane, decyltrimethoxysilane, hexadecyltrimethoxysilane, trimethyltrimethoxysilane, hexamethyldisilazane, N,O-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, vinyltriacethoxysilane, γ-methacryloxypropyltrimethoxysilane, β-(3,4-epoxycyclohexyl)ethyltrimethoxysilane, γ-glycydoxypropyltrimethoxysilane, γ-glycydoxypropyltriethoxysilane, γ-glycydoxypropylmethyldiethoxysilane, γ-mercaptopropyltrimethoxysilane, γ-chloropropyltrimethoxysilane and the like.

Further, there may be mentioned a fluorine compound which is obtained by replacing the hydrogen atoms of part of the above-mentioned compounds with fluorine atoms. The specific example includes a fluorine-based silane compound such as trifluoropropyltrimethoxysilane, tridecafluorooctyltrimethoxysilane, heptadecafluorodecyltrimethoxysilane, heptadecafluorodecylmethyldimethoxysilane, tridecafluoro-1,1,2,2-tetrahydrooctyltriethoxysilane, 3,3,3-trifluouropropyltrimethoxysilane, heptadecafluoro-1,1,2,2-tetrahydrodecyltriethoxysilane and 3-heptafluoroisopropoxypropyltriethoxysilane. In addition, there may be mentioned, but not limited to, an amino-based silane compound which is obtained by replacing part of the hydrogen atoms with amino groups.

In addition, the silicone oil includes, but is not limited to, for example, dimethylsilicone oil, methylhydrogensilicone oil, methylphenylsilicone oil, cyclic dimethylsilicone oil, epoxy-modified silicone oil, carboxy-modified silicone oil, carbinol-modified silicone oil, methacryl-modified silicone oil, mercapto-modified silicone oil, polyether-modified silicone oil, methylstyryl-modified silicone oil, alkyl-modified silicone oil, amino-modified silicone oil, fluorine-modified silicone oil and the like.

The tribo value of toner under a high humidity may be improved by adding inorganic fine particles subjected to hydrophobic treatment, and thereby the environmental stability of tribo charging is improved. As the hydrophobic treatment method for inorganic fine particles, there may be used a conventionally known method. For example, a method in which a hydrophobic agent is mixed and diluted with a solvent such as tetrahydrofuran, toluene, ethyl acetate, methylethylketone and acetone, the diluted hydrophobic agent is dropped or sprayed into inorganic fine particles which are forcibly stirred with a blender and the like so as to be added and mixed each other, the inorganic fine particles is washed and filtered where necessary and then the inorganic fine particles are heated and dried, followed by crushing the agglomerate after drying in a blender or mortar or the like; a method in which inorganic fine particles are immersed in a solvent solution of a hydrophobic agent, followed by drying and crushing the inorganic fine particles; a method in which a hydrophobic agent solution is dropped into inorganic fine particles dispersed in water in a slurry state and then the inorganic fine particles are precipitated, followed by heating and drying the inorganic fine particles to be crushed; and a method in which a hydrophobic agent is directly sprayed into inorganic fine particles.

The amount of the hydrophobic agent which is attached to inorganic fine particles is preferably 0.01 to 50% by weight and more preferably 0.1 to 25% by weight relative to inorganic fine particles. The attached amount of the hydrophobic agent may be changed by a method in which the mixed amount of the hydrophobic agent is increased at the stage of treatment, the number of the washing process after treatment is changed or the like. In addition, the attached amount of the hydrophobic agent may be quantified by XPS (X-ray photoelectron spectroscopy) or elemental analysis. If the attached amount of the hydrophobic agent is excessively small, the tribo charging property tends to decrease under a high humidity. In addition, if the attached amount of the hydrophobic agent is excessively large, there is a tendency that the tribo charging is excessively increased under a low humidity or the released hydrophobic agent deteriorates the powder fluidity of the developing agent.

Similarly, in addition to the above-mentioned inorganic fine particles, organic fine particles may be added to the toner used in the present exemplary embodiment. The organic fine particles include, for example, vinyl-based polymer such as styrene-based polymer, (meta)acrylate-based polymer and ethylene-based polymer; various kinds of polymer such as ester-based polymer, melamine-based polymer, amide-based polymer and allylphthalate-based polymer; fluorine-based polymer such as vinylidene fluoride polymer; fine particles comprising a higher alcohol such as Unilin and the like. Among these, the organic fine particle having a primary particle diameter of 0.05 to 7.0 μm is preferably used. These organic fine particles are typically added for the purpose of improving the cleaning property and transfer property of toner.

Further, the inorganic fine particles or organic fine particles to be added to the toner may be attached or fixed on the surface of the toner particles by applying a mechanical impact force to the particles together with the toner particles using a sample mill or Henschel mixer or the like.

In the present exemplary embodiment, the shape factor SF of toner used is preferably larger than 140. Here, the shape factor of toner SF is defined by the following equation (2)

$$SF=100\times(\pi/4)\times(ML^2/M) \quad (2)$$

In the equation (2), ML represents the absolute maximum length of toner particles. M represents the projected area of toner particles. In case of the particle which is completely a sphere, the shape factor SF is 100, and the shape factor value is getting larger as the strain is greater. The absolute maximum length of toner particles and the projected area of toner particles are quantified by mainly analyzing an optical microscope image or a scanning electron microscope image using an image analysis apparatus.

For example, an optical microscopic image of toner particles sprayed on a slide glass is taken in an image analysis apparatus (LUZEX III: manufactured by NIRECO Corporation) through a video camera to measure the diameter corresponding to a circle, and the shape factor SF is calculated for 50 toner particles from the absolute maximum length (ML) and the projected surface area (S) by using the equation (2).

Since a toner having a shape factor SF of greater than 140 is typically produced by a pulverization method and has less water molecule content on the surface of the toner than a toner produced by using a chemical production method, the cohesive force of particles is decreased, thus tending to be excellent in the fluidity of toner and the conveying property of the toner within the toner cartridge 13.

(Production Method of Toner)

As the toner used in the present exemplary embodiment, there may be preferably used, for example, a pulverized toner or a pulverized and molten toner which is prepared by melting and blending main and sub raw materials and then finely pulverizing the raw materials. Such pulverized toner is preferable for the point that, for example, the adsorptive force between particles may be decreased and the degree of blocking may be reduced, compared to the chemical spherical toner obtained by chemical technique. In the chemical technique, toner is prepared by wet pulverizing the constituents (pigments and the like) of toner, by dispersing them in water and finally by drying the toner containing water with hot air. Accordingly, the remaining amount of water molecule on the surface of toner particles is larger compared to that of the toner prepared by the pulverization method, and the adsorptive force between particles tends to increase, thus easily causing blocking.

The production method of toner includes a conventionally known method and is not particularly limited. For example, there may be adopted any of methods for producing toner through the following processes: a melting and blending process by using a triple roll type, a single-screw type, a twin-screw type, a Bunbury mixer type or the like; a pulverization process by using a mechanical system or an impact system; a classification process by using a centrifugation type or a Coanda effect type; a process giving roundness to the surface shape by spraying toner into hot air; a process of mixing an external additive by using a V blender, a Henschel mixer, a mechanofusion system or the like; and a sieving process by using a mesh having an opening of 20 to 200 μm.

EXAMPLES

Hereinafter, the present invention will be explained based on examples. Meanwhile, the present invention is not limited to these examples. In addition, "parts" in the following examples indicates "parts by weight."

(1) Preparation of Toner

Production Example 1

Each of 88 parts of a polyester resin (a polyester obtained from terephthalic acid, bisphenol A-ethylene oxide adduct and trimellitic acid anhydride: glass transition temperature 62 degree C., number average molecular weight 5,320, weight average molecular weight 24,500, acid value 17, hydroxyl value 33), 7 parts of a polyethylene wax (Polywax 725: produced by Toyo-Petrolite Co., Ltd., DSC endothermic peak 102 degree C.) and 5 parts of a black pigment (Carbon Black #25B: produced by Mitsubishi Chemical Corp.) is added and preliminarily mixed and then kneaded with an extruder, followed by pulverizing the mixture by a jet mill.

Next, the pulverized product is classified by using Coanda effect type classifier to obtain a classified product having a volume median particle diameter of 6.5 μm and a 20 particles percentage of not more than 4 μm. 0.1 parts by weight of a hydrophobic titanium oxide compound and 1.2 parts by weight of a silicone oil treated silica are externally added and mixed by Henschel mixer relative to 100 parts by weight of the resulting classified product and then sieved with a mesh having an opening of 38 μm, followed by removing the resulting agglomerate to obtain toner A. The titanium oxide is a hydrophobic titanium oxide having an average particle diameter of 0.03 μm which is obtained by using ilmenite ore, according to the following process: ilmenite ore is dissolved in sulfuric acid to separate iron powder, and 5 parts of $SiCl_4$ is added relative to 100 parts of the resulting $TiOSO_4$ to hydrolyze and then washed with water to obtain $TiO(OH)_2$ containing a Si component; then, 5 parts of decyltrimethoxysilane and 5 parts of silicone oil are added relative to 100 parts of $TiO(OH)_2$ that are not sintered to wet treat and then dried, followed by pulverizing the resulting product by a jet mill. The silica is a silicone oil treated silica (trade name: RY200, produced by Nippon Aerosil Co., Ltd.) having a primary particle size of 0.012 μm. The toner A has a compression ratio of 0.31 and a shape factor SF of 140.

Production Example 2

A classified product having a volume median particle diameter of 6.5 μm is obtained by the same production method as that in the production example 1 and then the additive amount of the silicone oil treated silica as an external additive is changed to 0.8 parts by weight and the additive amount of the titanium compound is changed to 0.2 parts by weight to obtain toner B. The toner B has a compression ratio of 0.38 and a shape factor SF of 142.

Production Example 3

Toner C is obtained in the same way as that in the production example 1 except that the additive amount of the silicone oil treated silica having a particle size of 0.012 μm as an external additive is 2 parts by weight, the additive amount of the titanium compound is 0.2 parts by weight and further 1 part by weight of a silicone oil treated silica (primary particle diameter of 0.1 μm) is added. The toner C has a compression ratio of 0.25.

Production Example 4

Toner particles are prepared by employing the emulsion aggregation method described below.

(Preparation of Anionic Resin Fine Particle Dispersion Liquid)

A solution is prepared by mixing and dissolving each component of 480 parts by weight of styrene, 120 parts by weight of n-butylacrylate, 12 parts by weight of acrylic acid and 12 parts by weight of dodecanetiol. On the other hand, 12 parts by weight of an anionic surfactant (Dowfax: produced by Rhodia Inc.) is dissolved in 250 parts by weight of ion exchanged water and the above-mentioned solution is added to the resulting solution to disperse and emulsify in a flask (monomer emulsion A).

Further, 1 part by weight of an anionic surfactant (Dowfax: produced by Rhodia Inc.) is dissolved in 555 parts by weight of ion exchanged water and the resulting solution is charged in a polymerization flask. The polymerization flask is sealed, and a reflux tube is equipped therewith. Under injection of nitrogen, the polymerization flask is heated to 75 degree C. in a water bath while slowly stirred, and that condition is maintained. 9 parts by weight of ammonium persulfate is dissolved in 43 parts by weight of ion exchanged water, and the resulting solution is dropped into the polymerization flask through a metering pump for 20 minutes. Then, the monomer emulsion A is dropped also through a metering pump for 200 minutes. Thereafter, the polymerization flask is maintained at 75 degree C. for three (3) hours while slowly stirred to complete the polymerization. Consequently, there is obtained an anionic resin fine particle dispersion liquid having the anionic resin fine particle of which a median diameter is 230 nm, a glass transition point is 52.5 degree C. and a weight average molecular weight is 22,000, and a solid content thereof is 42%.

(Preparation of Yellow Colorant Particle Dispersion Liquid)

Each component of 50 parts by weight of C.I. Pigment Yellow 74 (PY 74, produced by Clariant (Japan) K.K.), 5 parts by weight of an anionic surfactant (Neogen R, produced by Daiichi Kogyo Seiyaku Co., Ltd) and 200 parts by weight of ion exchanged water is mixed and dissolved and then the resulting solution is dispersed by a homogenizer (Ultra-Turrax, manufactured by IKA Co., Ltd.) for ten (10) minutes to obtain a yellow colorant particle dispersion liquid having the yellow colorant particle of which a median diameter is 200 nm and a solid content is 21.5%.

(Preparation of Release Agent Particle Dispersion Liquid)

Each component of 50 parts by weight of Polywax 725 (produced by Toyo-Petrolite Co., Ltd., melting point: 100 degree C.), 5 parts by weight of an anionic surfactant (Dowfax: produced by Rhodia Inc.) and 200 parts by weight of ion exchanged water is heated to 110 degree C. and the resulting solution is sufficiently dispersed by a homogenizer (Ultra-Turrax T50, manufactured by IKA Co., Ltd.) and then the resulting solution is dispersion-treated by a pressure discharge type homogenizer (a Gaulin homogenizer, manufactured by Gaulin Corporation) to obtain a release agent particle dispersion liquid having the release agent particle of which a median diameter is 150 nm and a solid content is 21.0%.

(Preparation of Toner Particles)

Each component of 227 parts by weight (84 parts by weight of the resin) of the anionic resin fine particle dispersion liquid, 40 parts by weight (8.6 parts by weight of the pigment) of the yellow colorant particle dispersion liquid, 40 parts by weight (8.6 parts by weight of the release agent) of the release agent particle dispersion liquid and 0.15 parts by weight of aluminum polychloride is sufficiently mixed and dispersed in a round-bottom stainless steel flask with a homogenizer (Ultra-Turrax T50, manufactured by IKA Co., Ltd.) and then heated to 48 degree C. in a heating oil bath while stirred. After maintaining at 48 degree C. for 60 minutes, 68 parts by weight (28.6 parts by weight of resin) of the anionic resin fine particle dispersion liquid is added, followed by gradually stirred.

Thereafter, the pH of the system is adjusted to 6.0 with a sodium hydroxide aqueous solution, and then the system is heated to 95 degree C. under continuous stir. During increasing the temperature to 95 degree C. and maintaining at the temperature, a sodium hydroxide aqueous solution is additionally dropped so that the pH of the system is not more than 5.5.

After completing the reaction, the contents of the flask are cooled, filtered and sufficiently washed with ion exchanged water, followed by subjecting to solid-liquid separation by Nutsche suction filtration. The resulting product is redispersed in three (3) liters of ion exchanged water at 40 degree C., and then stirred at 300 rpm for 15 minutes and then washed. The washing operation is repeated five (5) times, and then the product is subjected to solid-liquid separation by Nutsche suction filtration, followed by subjecting to vacuum drying for 12 hours to obtain toner particles.

The measurement of the toner particles with a Coulter counter shows a volume median particle diameter D50 of 5.8 μm and a shape factor SF of the toner particles of 132.

1.2 parts by weight of hydrophobic silica (TS720, produced by Cabot Corporation) is added to 50 parts by weight of above-mentioned toner particles, followed by mixed in a sample mill to obtain an external addition toner D. The toner D has a compression ratio of 0.38.

Production Example 5

Toner particles are prepared in the same production method as in the production example 4. The toner has a volume median particle diameter of 6.0 μm and a shape factor SF of 123. 1.4 parts by weight of hydrophobic silica (TS720, produced by Cabot Corporation) is added to 50 parts by weight of the toner particles, followed by mixed in a sample mill to obtain an external addition toner E. The toner E has a compression ratio of 0.38.

Production Example 6

Toner P is obtained in the same way as that in the production example 1 except that the additive amount of silica as an external additive is decreased to 0.8 parts by weight and is evaluated. The toner P has a compression ratio of 0.41.

Production Example 7

Toner Q is obtained in the same way as that in the production example 1 except that the additive amount of the silicone oil treated silica is increased to 2.5 parts by weight and is evaluated. The toner Q has a compression ratio of 0.23.

Production Example 8

Toner L is obtained in the same way as that in the production example 4 except that the additive amount of hydrophobic silica (TS720, produced by Cabot Corporation) is decreased to 0.9 parts by weight and is evaluated. The toner L has a compression ratio of 0.42.

Further, various kinds of toner A to L are mixed with a ferrite carrier having a number average particle diameter of 40 μm coated with styrene-methylmethacrylate copolymer (composition ratio: 40:60, weight average molecular weight: 80,000) so that the toner concentration is 8% and a developing agent is obtained.

(2) Measurement of Remaining Toner Amount

Figure 10:
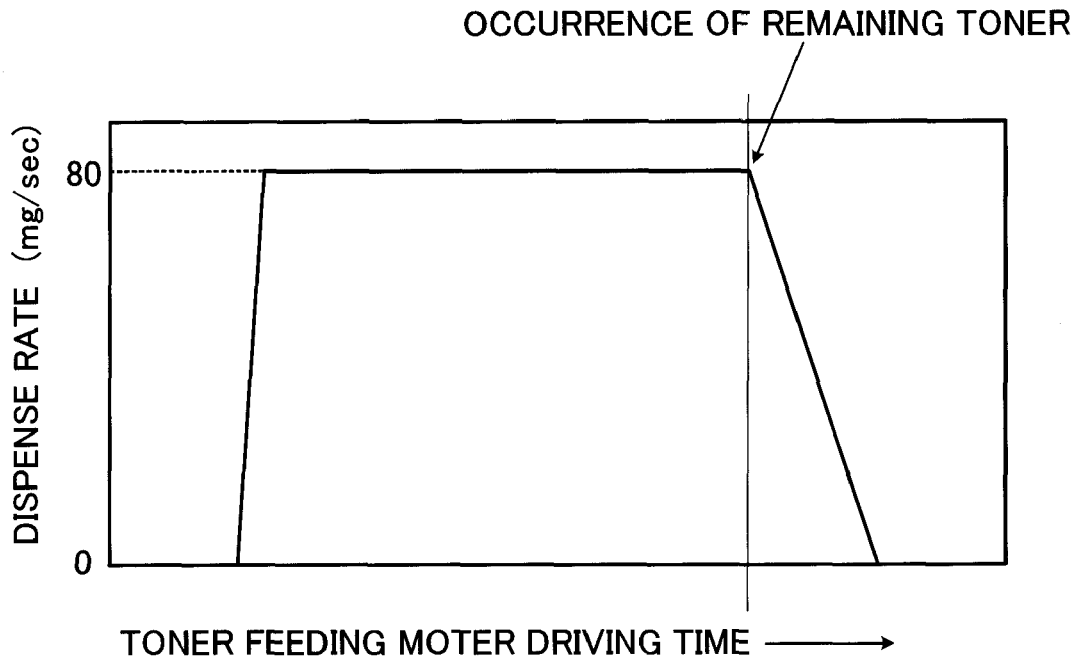
FIG. 10 is a graph showing the relationship between the toner feed rate per unit time supplied from the toner cartridge mounted on the image forming apparatus to the developing device (dispense rate) and the toner feeding motor driving time.

FIG. 10 is a graph showing the relationship between the toner feed rate (Dispense Rate) per unit time supplied from the toner cartridge 13 mounted on the image forming apparatus to the developing device 11 and the toner feeding motor driving time.

Here, the toner feeding motor driving time indicates the total time for driving a conveying paddle disposed in the toner feeding pipe (not shown in the figure) connecting the toner feeding opening 111 of the toner cartridge 13 of each color with the developing device 11 (refer to FIG. 1). The motor for driving the conveying paddle is turned on and off by a signal from the image forming apparatus to supply the toner. When a sufficient amount of toner is present in the feed toner storing container 104 and sufficient toner is supplied from the toner feeding opening 111 to the toner conveying pipe, a predetermined dispense rate (mg/sec) is maintained. However, the amount of the toner in the feed toner storing container 104 becomes small, sufficient toner is not supplied from the toner feeding opening 111 to the toner conveying pipe and dispense rate is reduced. Then, as shown in FIG. 10, if the toner feeding amount is not maintained at 80 mg/sec optimal for the present image forming apparatus, the toner concentration in the developing device 11 is decreased and the image density is less than a predetermined value. The weight of toner remained in the feed toner storing container 104 at this time is measured as the remaining toner weight. In the present image forming apparatus, if dispense rate (mg/sec) is less than 80 mg/sec, the toner concentration in the developing device 11 is insufficient, thereby causing a defect in which the image density does not satisfy the predetermined value.

(3) Measurement of Compression Ratio of Toner

An aerated bulk density (A) and a packed bulk density (P) are measured by a powder tester (Powder Tester PT-S: manufactured by Hosokawa Micron Corporation) and a compression ratio is determined from the measured values based on the equation (1).

The aerated bulk density (A) of the toner is measured according to the following operations.

A measurement cup having a diameter of 5 cm, a height of 5.2 cm and a capacity of 100 cc is prepared. Next, a toner flows down at the upper side of the measurement cup with a predetermined flow rate to fill the cup with the toner. At this time, the flow rate of the toner is adjusted so that the toner is piled up on the upper side of the measurement cup for approximately 20 to 30 seconds. When the toner is piled up on the upper side of the measurement cup, the top surface of the measurement cup is rapidly leveled by a metal blade.

Subsequently, the weight ($M_1$ grams) of the toner filled in the measurement cup is weighed and the weight is divided by the volume (100 cc) of the measurement cup ($M_1/100$) to determine an aerated bulk density (A).

In addition, the packed bulk density (P) is measured according to the following operations.

The attached cap is connected to the upper side of the measurement cup used for the measurement of the aerated bulk density (A). Next, the toner is gently filled to the upper side of the cap connected to the upper side of the measurement cup. Subsequently, while keeping the state where the cap is connected, the measurement cup is tapped 180 times. After the completion of the tapping, the cap connected to the upper side of the measurement cup is removed and then the excessive toner piled up on the upper side of the measurement cup is leveled.

The weight ($M_2$ grams) of the toner filled in the measurement cup is weighed and the weight is divided by the volume (100 cc) of the measurement cup ($M_2/100$) to determine a packed bulk density (B).

Examples 1 to 5 and Comparative Examples 1 to 3

As mentioned above, 8 kinds of preprepared toner having a different compression ratio defined by equation (1) (Toner A to Toner E, Toner P, Toner Q and Toner L) are sequentially filled in each feed toner storing container 104 and the image evaluation is performed. Here, the volume of the feed toner storing container 104 is 160 cc and each toner amount filled is 50 grams.

In the present examples, among the four toner cartridges 13 mounted on the image forming apparatus shown in FIG. 1, only the toner cartridge 13B is used to perform single-color printing. The toner cartridge 13B is set to the image forming apparatus shown in FIG. 1 and the weight per unit time (dispense rate (mg/sec)) of the toner supplied from the feed toner storing container 104 to the developing device 11 is set to 80 mg/sec. Then, continuous printing is performed on the test image with an image area percentage of 5% under the condition of 20 degree C. and 60% RH (Relative Humidity), followed by evaluation of the toner cartridges 13B in accordance with following criteria. The evaluation results of the toner cartridge 13B are shown in Table 1.

(Remaining Amount Determination)

○: The remaining amount of toner is less than 5 grams

Δ: The remaining amount of toner is 5 grams

×: The remaining amount of toner exceeds 5 grams (Leakage from the Seal Portion)

○: There is no leakage from a portion between the toner feeding opening 111 and the seal portion 114

×: There is leakage from the portion between the toner feeding opening 111 and the seal portion 114

TABLE 1

| | | Toner | | | Evaluation of a toner cartridge | | |
|---|---|---|---|---|---|---|---|
| | | Kinds | Shape factor | Compression ratio | Toner remaining amount (grams) | Remaining amount determination | Leakage from the seal portion |
| Examples | 1 | Toner A | 140 | 0.31 | 2.5 | ○ | ○ |
| | 2 | Toner B | 142 | 0.38 | 3 | ○ | ○ |
| | 3 | Toner C | 140 | 0.25 | 1.5 | ○ | ○ |
| | 4 | Toner D | 132 | 0.38 | 5 | Δ | ○ |
| | 5 | Toner E | 123 | 0.38 | 5 | Δ | ○ |
| Comparative examples | 1 | Toner P | 140 | 0.41 | 10 | x | ○ |
| | 2 | Toner Q | 140 | 0.23 | 1.5 | ○ | x |
| | 3 | Toner L | 132 | 0.42 | 12 | x | ○ |

The results shown in Table 1 show when a toner having a compression ratio of 0.25 to 0.38 is used (examples 1 to 5), there is no leakage from the seal portion of the toner cartridge 13B and the toner remaining amount remained in the feed toner storing container 104 is not more than 5 grams. For this reason, it is considered that the fluidity associated with the compression ratio of toner set to 0.25 to 0.38 is in a suitable range for the toner cartridge 13B of the exemplary embodiment.

In addition, when the toner A, B or C having a shape factor SF of not less than 140 is used (example 1, 2 or 3), it is presumed that it is more excellent in fluidity compared to the case where the toner D or E is used (example 4 or 5), because the toner remaining amount is minimum, that is, 3 grams or less, and the toner sealing property is excellent. The detailed mechanism is unclear but it is considered that the toner particles prepared by a pulverization method exhibit the effect caused by the small remaining amount of water molecules on the surface of the particle, thereby resulting a lower cohesive force than the toner particles prepared by a polymerization method.

On the other hand, when toner having a compression ratio of more than 0.38 (comparative example 1 or 3) is used, the remaining toner amount remained in the feed toner storing container 104 is rapidly increased (exceeding 5 grams as shown in Table 1), that is, the amount of unused toner is increased in the image forming apparatus.

In addition, when toner having a compression ratio of less than 0.25 (comparative example 2) is used, the amount of the remaining toner in the feed toner storing container 104 is decreased, but the fluidity of the toner is excessively increased and the toner amount fed out from the toner feeding opening 111 is increased, and the toner leakage from the toner sealing portion occasionally happens. For this reason, there occurs a problem where stains around the toner feeding opening 111 get worse. Further, there also occurs a problem that dispense rate (mg/sec) exceeds a predetermined value and may not be stably controlled, thereby making it difficult to control the toner concentration in the developing device 11.

What is claimed is:

1. A toner cartridge comprising:

a toner storing container of a rectangular shape having a toner feeding opening in an angular portion thereof; and a stirring conveying member that is rotatably disposed inside the toner storing container in a predetermined rotation direction and that stirs and conveys toner toward the toner feeding opening in the toner storing container, wherein compression ratio defined by the following equation (1) of the toner stored in the toner storing container is 0.25 to 0.38, $$\text{Compression ratio}=(P-A)/P \quad (1)$$

(Provided that in the equation (1), P represents a packed bulk density of toner and A represents an aerated bulk density of toner), wherein the stirring conveying member has an insertion portion insertable to the toner feeding opening at the tip side of the stirring conveying portion and a sliding portion that is disposed adjacent to the insertion portion, the sliding portion having a length from the rotation center longer than the insertion portion and sliding on the inside wall of the toner storing container.

2. The toner cartridge according to claim 1, wherein the toner has a shape factor (SF) defined by the following equation (2) of not less than 140

$$SF=100\times(\pi/4)\times(ML^2/S) \quad (2)$$

(Provided that in the equation (2), ML represents the absolute maximum length of toner particles and S represents a projected area of toner particles).

3. The toner cartridge according to claim 1, wherein the toner is a pulverized toner or a molten and pulverized toner.

4. The toner cartridge according to claim 1, wherein the toner feeding opening is disposed on the angular portion at one side of the toner storing container of the rectangular shape in a longitudinal direction.

5. The toner cartridge according to claim 1, wherein the toner storing container has a toner-feeding-side area that is disposed inside of the toner storing container and that is formed in a circular arc shape along the longitudinal direction of the side where the toner feeding opening is located.

6. The toner cartridge according to claim 1, wherein the toner storing container is equipped with a curvature portion that is disposed inside the toner storing container and that is formed in a corner portion located on an upper side of the toner feeding opening in a state similar to the attachment state of the toner storing container to an image forming apparatus, the curvature portion having a bump raised upward from a changing point at the downstream side in the rotation direction of the stirring conveying member.

7. The toner cartridge according to claim 1, wherein the stirring conveying member comprises an axis portion rotatably supported in the toner storing container and a stirring conveying portion having a flexibility of being distorted by the pressure applied by the toner stored in the toner storing container and disposed on the axis portion, the axis portion comprises a plurality of protrusions that are disposed in the longitudinal direction of the axis portion and that protrude toward the outside from a rotation center, and the stirring conveying portion has a length such that a tip side away from the rotation center of the stirring conveying portion is able to slide on the inside wall of the toner storing container.

8. The toner cartridge according to claim 1, wherein the stirring conveying member has a plurality of slits that are formed at a portion corresponding to the toner-feeding-side area of the stirring conveying portion and have a predetermined oblique angle.

* * * * *